US006820664B1

(12) United States Patent
Ritch

(10) Patent No.: US 6,820,664 B1
(45) Date of Patent: Nov. 23, 2004

(54) BAG FOR CARRYING ARTICLES

(76) Inventor: Lisa M. Ritch, 1848 Yesteroaks Ct., Asheboro, NC (US) 27205

( * ) Notice: Subject to any disclaimer, the term of this patent is extended or adjusted under 35 U.S.C. 154(b) by 0 days.

(21) Appl. No.: 10/151,391

(22) Filed: May 20, 2002

(51) Int. Cl.[7] ..... A45C 3/08
(52) U.S. Cl. ..... 150/103; 190/110
(58) Field of Search ..... 150/103, 104–109, 150/113; 383/111; 190/110

(56) References Cited

U.S. PATENT DOCUMENTS 1,284,350 A * 11/1918 Hunt ..... 150/107
1,960,396 A * 5/1934 Rosenberg ..... 150/105
1,990,360 A * 2/1935 Anish ..... 150/105
2,053,464 A * 9/1936 Dalsheim ..... 150/105
2,131,382 A * 9/1938 Lobel ..... 150/105
2,355,155 A * 8/1944 Greenfield ..... 150/104
2,437,382 A * 3/1948 Czap ..... 150/105
4,766,613 A 8/1988 Wells
5,207,254 A 5/1993 Fromm
5,209,279 A * 5/1993 Wilson ..... 150/111
D339,683 S 9/1993 Zavitz
5,774,892 A 7/1998 Tisdale et al.
5,894,975 A * 4/1999 Holden et al. ..... 224/582
6,003,573 A 12/1999 Owens
6,129,126 A * 10/2000 Restivo ..... 150/105
D452,988 S 1/2002 Ergezinger et al.
6,543,499 B2 * 4/2003 McCreery ..... 150/104

* cited by examiner

*Primary Examiner*—Lien Ngo

(57) ABSTRACT

A portable bag such as handbag, backpack or the like has an inner pocket for carrying articles and an outer exchangeable cover such as formed from leather, fabric, vinyl or otherwise. The inner pocket includes an upper band which is flexible for pivoting and concealing a fastener therebeneath. The outer cover similarly includes a fastener for engaging the fastener positioned on the inner pocket whereby the outer cover can be slid over the inner pocket and the fasteners secured.

16 Claims, 6 Drawing Sheets

BAG FOR CARRYING ARTICLES

FIELD OF THE INVENTION

The invention herein pertains to portable bags for carrying articles and particularly pertains to bags such as ladies handbags having exchangeable covers.

DESCRIPTION OF THE PRIOR ART AND OBJECTIVES OF THE INVENTION

Convertible handbags and garments have been used for many years to accommodate the current desires and needs of the user. U.S. Pat. Nos. 6,003,573; 5,207,254 and Des. 339,683 demonstrate conventional handbags that allow the outer portion of the bag to be changed, depending on the whims of the user. In addition, convertible garments have been designed in the past as shown in U.S. Pat. Nos. 4,766,613; 5,774,892 and Des. 452,988. Also a prior convertible garment with a zipper concealed beneath a band is shown in FIG. 7 herein.

Certain of the prior art devices shown are difficult to manipulate and connect while others do not provide the practicality required due to their complexity, cost and expense. For example, some of the convertible handbags which are presently available have covers which are difficult to exchange and are expensive to manufacture and purchase.

Therefore, with the problems and difficulties associated with conventional convertible handbags, the present invention was conceived and one of its objectives is to provide a handbag or other device for carrying desired objects such as food or the like which is easy to use and simple to connect.

It is another objective of the present invention to provide a bag which has a relatively basic structure for ease and economy in manufacturing and use.

It is still another objective of the present invention to provide a bag which includes a pivotal band which can be pivoted to access a fastener therebeneath.

It is also an objective of the present invention to provide a bag which is inexpensive and which can be conveniently converted into various styles such as formal wear, as desired by exchanging the outer cover.

It is still another objective of the present invention to provide a bag for carrying articles, which in an alternate embodiment includes a pair of fasteners.

Various other objectives and advantages of the present invention will become apparent to those skilled in the art as a more detailed description is set forth below.

SUMMARY OF THE INVENTION

The aforesaid and other objectives are realized by providing a bag for carrying articles such as a ladies handbag which includes an inner pocket having an upper pivotal band around the pocket opening with handles attached thereto. Also affixed to the inner pocket is a fastener half such as a zipper half concealed beneath the band. A variety of cover styles formed from different fabrics, materials and designs can be made as covers for the inner pocket to convert the bag from an informal handbag to one having a more stylish, formal appearance. The outer cover includes a fastener half such as a zipper half which will mesh with the fastener half on the inner pocket to securely combine the cover and inner pocket. Various embodiments of the invention are disclosed as for example, a handbag having two independent concealed zippers and in another embodiment, a backpack is disclosed.

DETAILED DESCRIPTION OF THE PREFERRED EMBODIMENT AND OPERATION OF THE INVENTION

Figure 3:
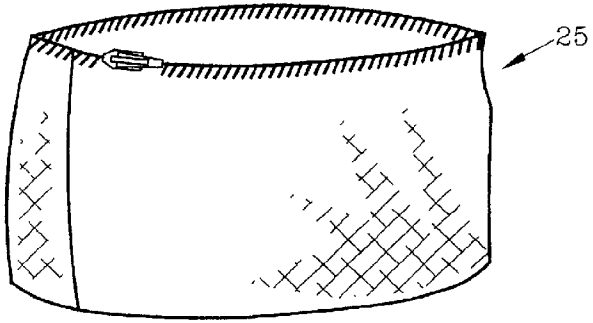
FIG. 3 illustrates an alternate cover for use with the bag seen in FIG. 1.
Figure 1A:
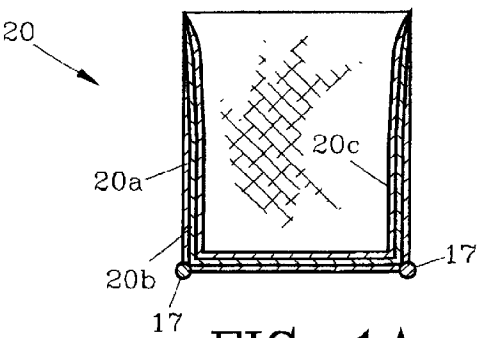
FIG. 1A pictures a cross-sectional view of the cover of FIG. 1 along lines 1A—1A.
Figure 1:
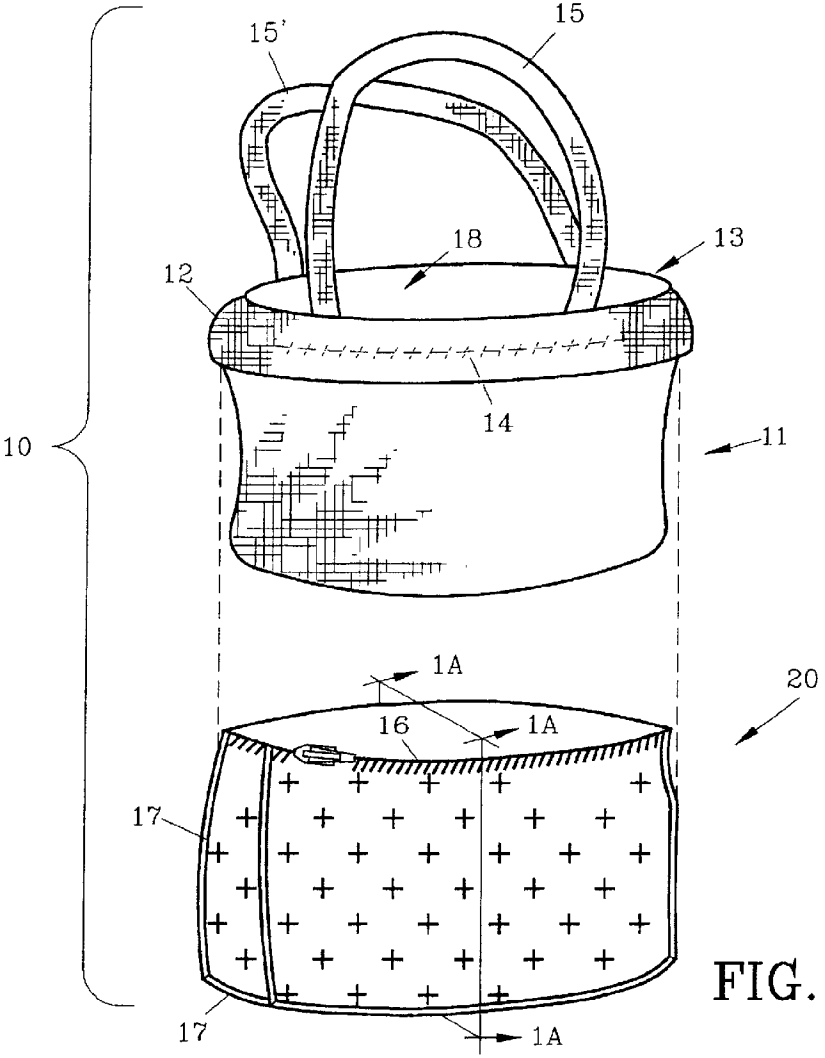
FIG. 1 demonstrates the preferred form of a bag for carrying articles with the cover exploded from the inner pocket.
Figure 2:
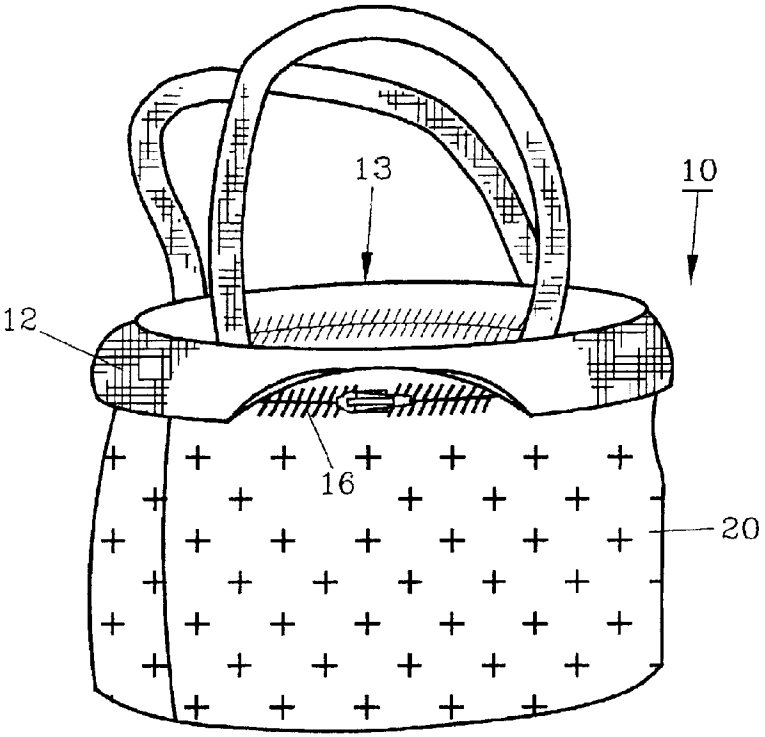
FIG. 2 shows the bag of FIG. 1 in assembled fashion.

For a better understanding of the invention and its operation, turning now to the drawings, FIG. 1 shows preferred pocketbook 10 having an inner pocket 11 formed from a suitable fabric such as cotton, nylon or a blended fabric with pivotal band 12, formed preferably of vinyl, affixed along and encircling upper edge 13 of inner pocket 11. Fastener half 14 which is preferably a standard zipper half is positioned on inner pocket 11, concealed beneath band 12. Handles 15, 15' are attached to inner pocket 11 and band 12 on opposite sides of opening 18 such as by sewing or the like. Band 12 may be formed of fabric, vinyl (polyvinyl chloride), leather or the like and is flexible for lifting or pivoting as shown in FIG. 2 to reveal engagement of fastener halves 14 and 16 as shown in FIG. 1. Cover 20 seen exploded from inner pocket 11 in FIG. 1 may be formed for example from leather and is sized to fit and engulf inner pocket 11 with second fastener half 16 engaging first fastener half 14 as shown in FIG. 2. In FIG. 1A cover 20 is shown in cross section with outer leather layer 20*a* and stiff intermediate layer 20*b* formed of a somewhat hard fabric, flexible plastic or mesh to provide and maintain shape to outer layer 20*a*. Inner layer 20*c* is formed from a lightweight, thin durable fabric. Layers 20*a*, 20*b* and 20*c* are attached along the top edge as by sewing proximate fastener 16 (FIG. 1) and are tack sewn along the inside corners to avoid separation. Usual fabric piping 17 acts as a stiffener also to provide form and shape to cover 20. Other styles of covers may also be used such as outer cover 25 as shown in FIG. 3, formed from a colored fabric. Cover 25 can be substituted for outer cover 20 as desired. As would be understood, many various types and colors of fabrics, decorations and the like can be utilized depending on the style of the user as inner pocket 11 will support a variety of outer covers such as 20 and 25 seen in FIGS. 1 and 3. Fastener halves 14 and 16 as shown in FIGS. 1 and 2 comprise conventional zipper halves although other types of fasteners can be employed such as conventional slide fasteners, hook and loop fasteners, adhesives, snaps, locking fasteners or the like although standard zipper fasteners attached by sewing are preferred.

Figure 4:
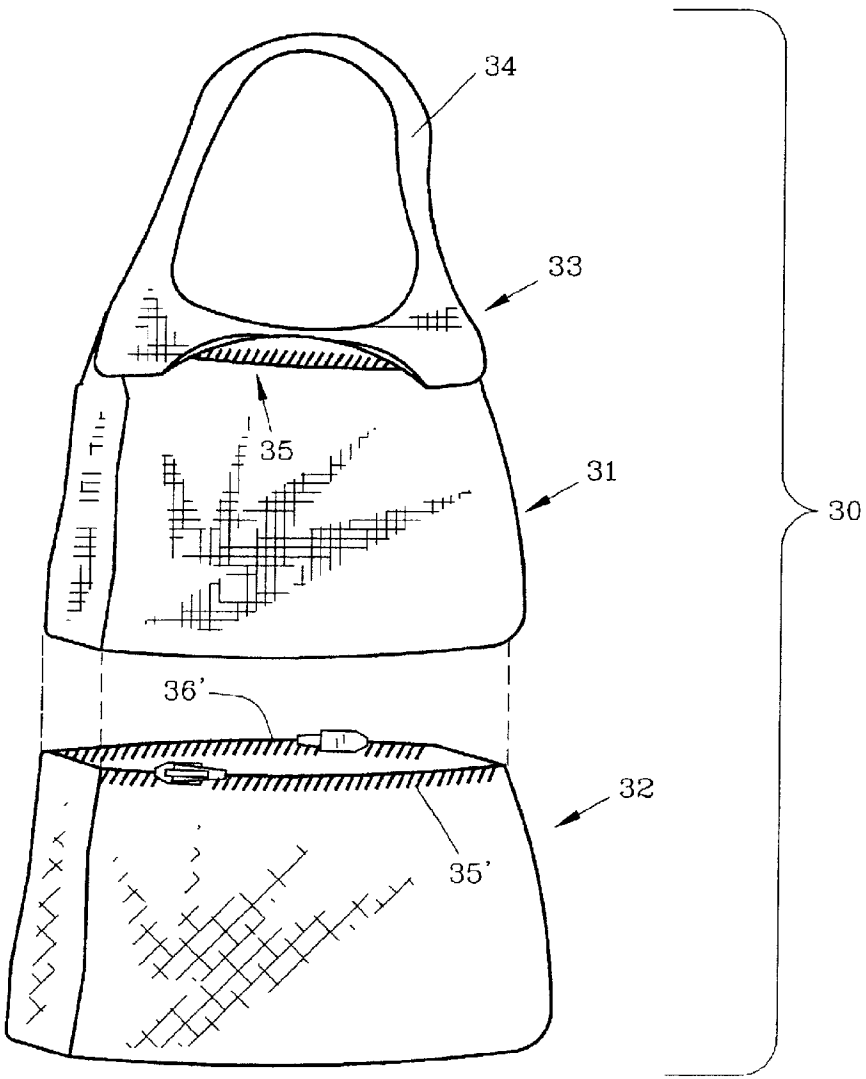
FIG. 4 depicts a first alternate embodiment of a bag from that shown in FIG. 1.

In FIG. 4, an alternate embodiment of the invention is shown with pocketbook 30. Pocketbook 30 includes an inner pocket 31 and cover 32. Front flange 33 on inner pocket 31 is flexible and can be pivoted upwardly as shown to expose front fastener half 35 attached to inner pocket 31. Front fastener half 35 will engage cover front fastener half 35' whereas rear fastener half 36' engages inner pocket rear fastener half 36 beneath rear flange 33' (not shown in FIG. 4). Thus, two zipper fasteners are provided to attach outer cover 32 to inner pocket 31 in a concealed manner. Front handle 34 and rear handle 34' surround the opening (not seen) of inner pocket 31. Various styles of cover 32 can be provided as described above.

Figure 5:
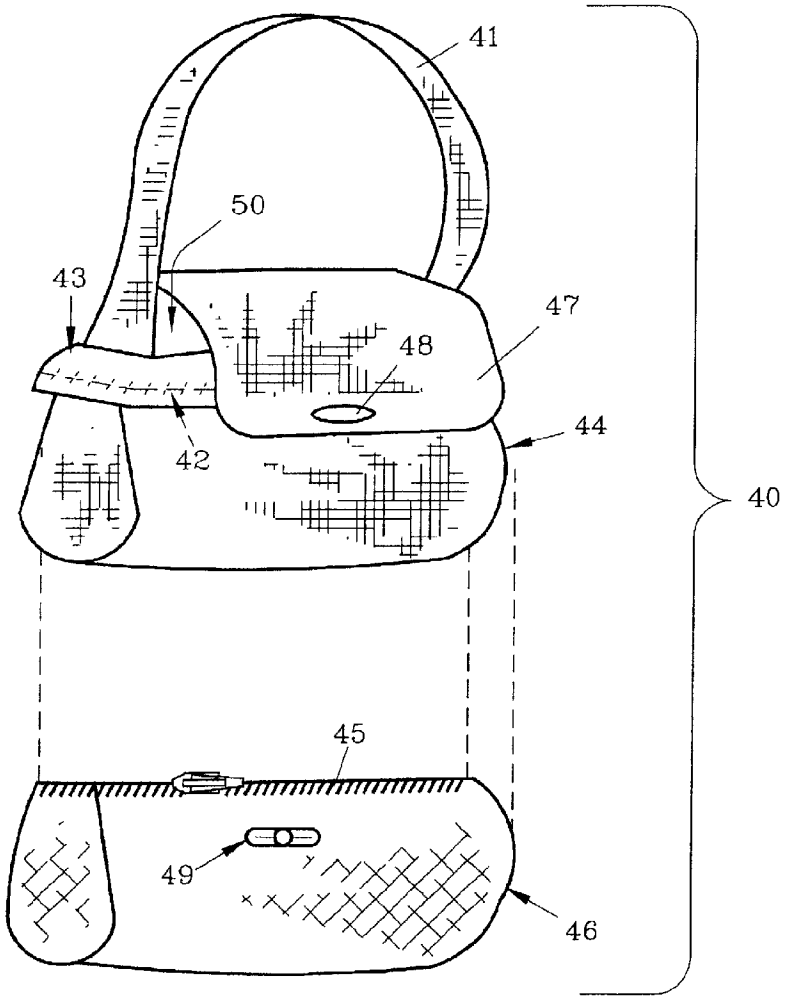
FIG. 5 features a second alternate embodiment of the bag shown in FIG. 1 with the cover exploded from the inner pocket.

In a further embodiment of the invention as shown in FIG. 5, pocketbook 40 includes single handle 41 and concealed fastener half 42 which is affixed beneath band 43 to inner pocket 44. Cover 46 is slid over inner pocket 44 whereby fastener half 45 meshes with inner pocket fastener half 42 to secure outer cover 46 to inner pocket 44. Conventional snap fastener 48 engages cover post 49 to secure flap 47 which surround opening 50 of inner pocket 44 beneath flap 47 thereby protecting the contents of inner pocket 44 when pocketbook 40 is fully assembled.

Figure 6:
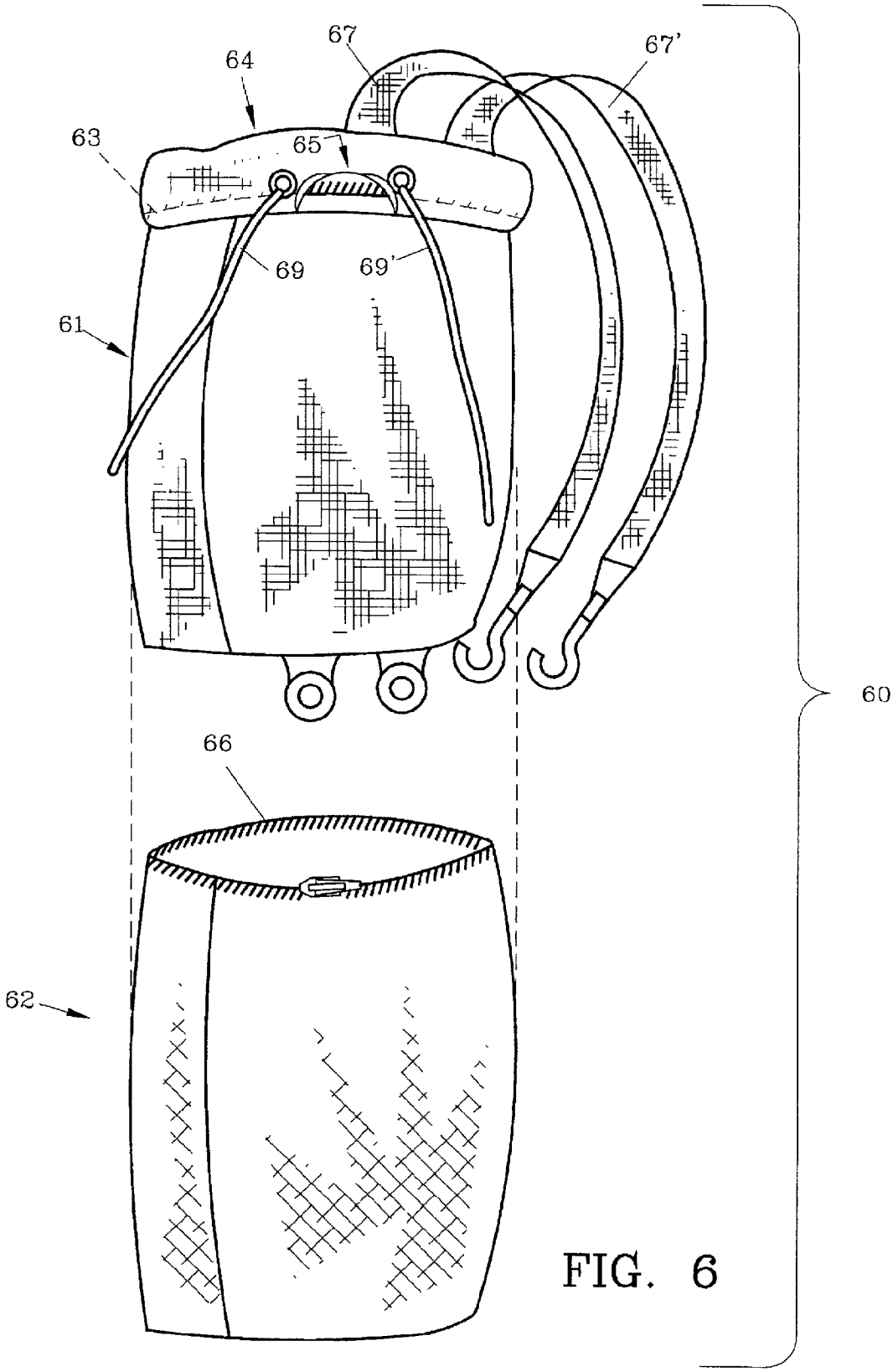
FIG. 6 shows a third embodiment of the invention in the form of a backpack with the cover exploded from the inner pocket.
Figure 7:
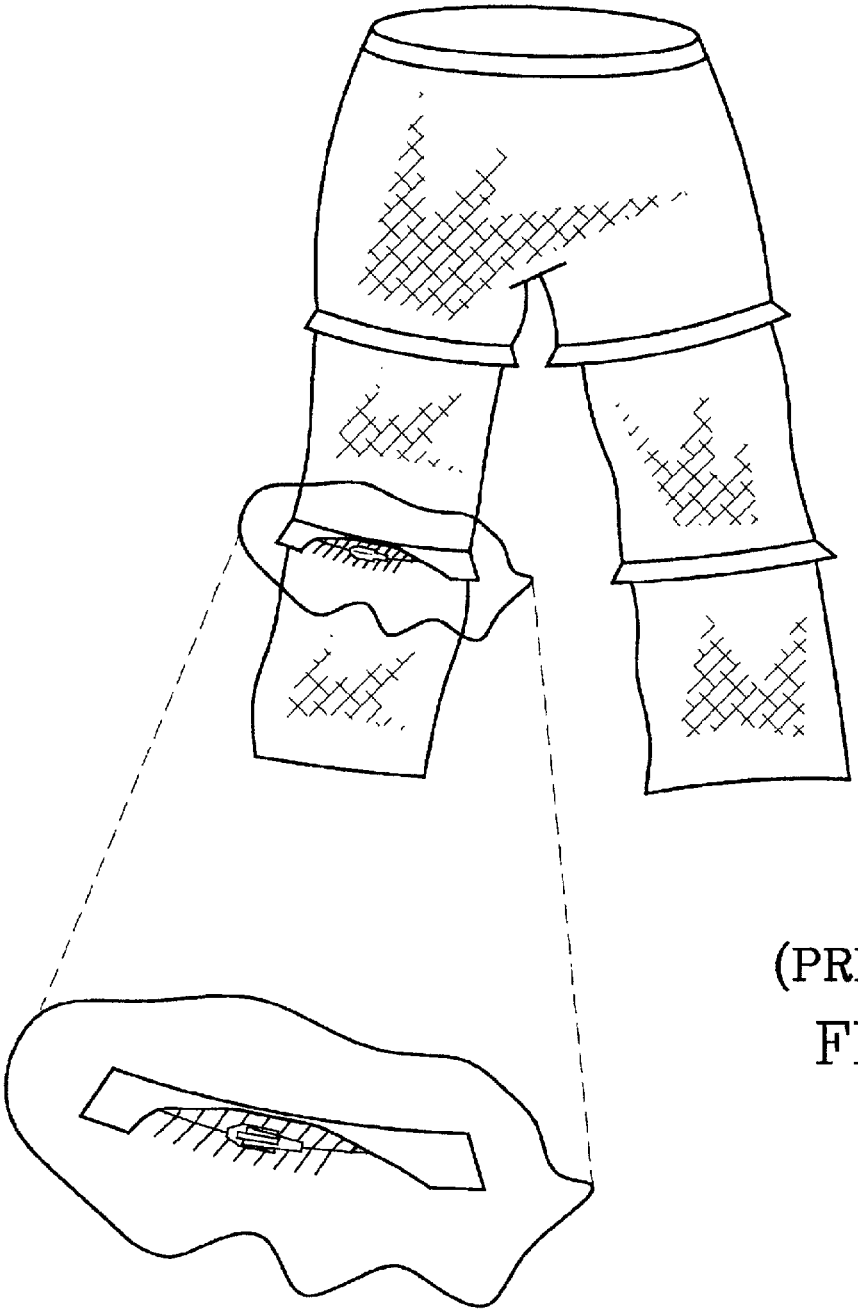
(PRIOR ART) FIG. 7
FIG. 7 demonstrates a conventional fastening system as used on clothing articles.

In FIG. 6 another embodiment of the invention is shown with backpack 60 having inner pocket 61 with outer cover 62 seen exploded therefrom. As would be understood, fastener half 63 is concealed beneath band 64 which is flexible and can be pivoted upwardly as seen at 65 to expose fastener half 63. Fastener half 66 on cover 62 will mesh with fastener half 63 to secure cover 62 around inner pocket 61. Shoulder straps 67, 67' likewise are affixed to inner pocket 61 while drawstrings 69, 69' are used to tighten the open top of inner pocket 61 and are tied as is conventional. As earlier discussed various covers could be provided and can be easily exchanged or replaced if worn or damaged.

The illustrations and examples provided herein are for explanatory purposes and are not intended to limit the scope of the appended claims.

I claim:

1. A bag for carrying articles therein comprising: an inner pocket, said inner pocket defining an upper edge, a pivotable band, said band completely encircling said inner pocket along said upper edge, a first fastener half, said first fastener half completely encircling said inner pocket and concealed beneath said pivotable band, an outer cover, said outer cover sized to fit over said inner pocket, said outer cover defining an upper edge, a second fastener half, said second fastener half completely encircling and affixed to said outer cover upper edge whereby said outer cover can be slid over said inner pocket with said second fastener half placed beneath said band and said second fastener half meshed with said first fastener to secure said outer cover completely around said inner pocket with said meshed fasteners totally concealed by said band.

2. The bag of claim 1 further comprising a handle, said handle affixed to said band.

3. The bag of claim 1, wherein said inner pocket is formed from fabric.

4. The bag of claim 1 wherein said band is formed from polyvinyl chloride.

5. The bag of claim 1 wherein said first fastener side comprises a continuous zipper half.

6. The bag of claim 1 wherein said second fastener half comprises a continuous zipper half.

7. The bag of claim 1 wherein said outer cover is formed from polyvinyl chloride.

8. The bag of claim 1 wherein said bag comprises a purse.

9. The bag of claim 1 wherein said bag comprises a backpack.

10. A bag for carrying articles having an exchangeable cover comprising: an inner pocket, said inner pocket defining an opening, a first fastener half, said first fastener half completely encircling and affixed to said inner pocket proximate said opening, a band, said band pivotally attached to said inner pocket, said band for concealing said first fastener half, a cover, said cover defining an opening, said cover opening for engulfing said inner pocket within said cover, a second fastener half, said second fastener half completely encircling and positioned on said cover proximate said cover opening, whereby said cover is placed over said inner pocket and said first fastener half meshed with said second fastener half completely therearound, as said band is pivoted and said meshed fastener halves totally concealed by said band.

11. The bag of claim 10 in comprising a pocketbook.

12. The bag of claim 10 comprising a backpack.

13. The bag of claim 10 wherein said cover is formed from fabric.

14. The bag of claim 10 wherein said cover is formed from leather.

15. The bag of claim 10 wherein said cover is formed from polyvinyl chloride.

16. The bag of claim 10 further comprising a shoulder strap, said shoulder strap attached to said inner pocket.

* * * * *